US007437825B2

(12) United States Patent
Sanders et al.

(10) Patent No.: US 7,437,825 B2
(45) Date of Patent: Oct. 21, 2008

(54) MECHANISM FOR CAN OPENER

(75) Inventors: Mark Andrew Sanders, Windsor (GB); Pat Yin Mah, Kowloon (HK)

(73) Assignee: Daka Research Inc., Tortolla (VG)

( * ) Notice: Subject to any disclaimer, the term of this patent is extended or adjusted under 35 U.S.C. 154(b) by 337 days.

(21) Appl. No.: 11/299,986

(22) Filed: Dec. 12, 2005

(65) Prior Publication Data

US 2007/0044326 A1 Mar. 1, 2007

(51) Int. Cl.
*B67B 7/46* (2006.01)

(52) U.S. Cl. ..... 30/422; 30/417; 30/418; 30/425

(58) Field of Classification Search ..... 30/417, 30/418, 422, 425, 427
See application file for complete search history.

(56) References Cited

U.S. PATENT DOCUMENTS

| | | | | | |
|---|---|---|---|---|---|
| 1,556,385 | A | * | 10/1925 | Waller | 30/418 |
| 1,945,137 | A | * | 1/1934 | Dahl | 30/418 |
| 2,461,015 | A | * | 2/1949 | Withrow | 30/417 |
| 2,522,382 | A | * | 9/1950 | Lampl | 30/422 |
| 2,522,383 | A | * | 9/1950 | Lampl | 30/422 |
| 2,592,936 | A | | 4/1952 | McLean | |
| 2,718,056 | A | | 9/1955 | Burnett | |
| 3,689,997 | A | | 9/1972 | McLean | |
| 4,365,417 | A | | 12/1982 | Rosendahl | 30/422 |
| 4,563,818 | A | | 1/1986 | Kreth et al. | |
| 4,825,554 | A | | 5/1989 | Koo | |
| 5,022,159 | A | | 6/1991 | Cressman et al. | |
| 5,313,708 | A | | 5/1994 | Edwards et al. | |
| 5,664,333 | A | | 9/1997 | Hardman | |
| 6,058,613 | A | * | 5/2000 | So | 30/418 |
| 6,182,368 | B1 | * | 2/2001 | So | 30/418 |
| 6,298,563 | B1 | | 10/2001 | Yeadon | |
| 6,351,889 | B1 | | 3/2002 | Wall et al. | |

(Continued)

FOREIGN PATENT DOCUMENTS

| | | |
|---|---|---|
| CA | 1200086 | 2/1986 |

(Continued)

OTHER PUBLICATIONS

German Patent No. 379929, of Aug. 31, 1923.

(Continued)

*Primary Examiner*—Hwei-Siu C. Payer
(74) *Attorney, Agent, or Firm*—Curtis L. Harrington; Kathy E. Harrington; Harrington & Harrington

(57) ABSTRACT

A mechanism is provided for use in a can opener comprising a body; rotationally mounting to the body about a first axis a drive wheel for engaging the rim of a can; rotationally mounting to the body about a second axis and drivably rotatable by the drive wheel, a cutter wheel; eccentrically mounting to said cutter wheel, a cutting knife movable on rotation of the cutter wheel to a cutting position in which the cutter knife forms a nip with the drive wheel such that the cutting knife penetrates through the cylindrical wall of the can, to provide a cut therein as the opener orbits relatively therearound, wherein the cutting position is defined by a cutting interval corresponding to a segment of rotation of the cutter wheel in which the cutting knife is sufficiently proximal to the drive wheel to form the nip.

29 Claims, 13 Drawing Sheets

U.S. PATENT DOCUMENTS

| | | | |
|---|---|---|---|
| 6,516,524 | B1 | 2/2003 | Brady |
| 6,739,061 | B1 | 5/2004 | Montel |
| 6,886,260 | B1 | 5/2005 | Lee |
| 2005/0235501 | A1 | 10/2005 | So |
| 2007/0033814 | A1 | 2/2007 | So et al. |

FOREIGN PATENT DOCUMENTS

| | | |
|---|---|---|
| EP | 0193278 | 9/1986 |
| EP | 0202790 | 11/1986 |
| EP | 0574214 | 12/1993 |
| GB | 820996 | 9/1959 |
| GB | 1215196 | 12/1970 |
| GB | 2118134 | 10/1983 |

OTHER PUBLICATIONS

Swiss Patent No. 471,034 "Buchsenoffner" by Walter Steiner Winterhur, Published Apr. 15, 1969.

EPO Patent No. 0137592 A1, to Mike & Kremmel Ltd & Raffo entitled "Improvements Relating to Can Openers" & Published Apr. 17, 1985.

French Patent registration 72.20542 published as 2.187.674 by Olof Thoren published Jan. 18, 1974 titled "Presse-Tube".

EPO Patent No. 0503931A1, to Wilson & Raffo entitled "Can Opener" & Published Sep. 16, 1992.

Japan Patent No. JP8113294 entitled "Electric Can Opener" issued May 7, 1996.

* cited by examiner

MECHANISM FOR CAN OPENER

BACKGROUND OF THE INVENTION

1. Field of the Invention

The present invention relates to can openers that may be provided with a manual or automated drive means.

2. Related Background Art

Metal cans are a well-known form of packaging for preserved goods and generally comprise a cylindrical wall portion closed at both ends with a circular lid. The lid is usually fixed in place by providing an upstanding rim around the edge of the lid. The rim is bent down in an inverted U-shape for clamping onto the end of the cylinder.

Two basic types of can opener are commonplace. The first type relies on making a circular cut around the lid near its edge typically within the upstanding rim. The second type relies on using a circular cutter knife to make a cut around the cylindrical wall portion of the can. Typically, the cut is made near the edge of the cylindrical part of the can but just below the lid so that when a complete circular cut is made, the lid and a small portion at the end of the cylindrical part of the can is removed. One advantage of this second type of can opener is that its cutter knife is designed to give a clean cutting action (as opposed to a tearing action, which typically is found with can openers of the first type).

United Kingdom Patent application no. GB 2 118 134 A1 describes a can opener of the second type comprising a pair of handles which are hinged to one another to be movable between an open position for fitting onto a can and a closed cutting position; a manually rotatable drive wheel which engages the rim of a can and upon rotation advances the opener around a can; and a circular cutting wheel brought to a cutting position relative to the drive wheel as the handles are brought to the closed position. The circular cutting wheel is rotatably mounted on one handle with its axis displaced from the axis of hinging. The other handle has an upstanding cylindrical spigot extending through a corresponding hole in the one handle and about which the one handle is hinged relative the other handle. A support for the drive wheel passes through and is rotatably born in the spigot with the axis of rotation of the drive wheel displaced from the axis of the spigot.

Can openers of the general type described in the GB 2 118 134 A1 document have been widely marketed for a number of years under the trademark Lift Off. Various improvements to such can openers have been described in later patent applications including Canadian patent application No. CA 1,200, 086 A1; and European patent applications Nos. EP 0 193 278 A1, EP 0 202 790 A1 and EP 0 574 214 A1.

One problem with the can opener of GB 2 118 134 A1 and of its later variations is that two separate kinds of actions are required to achieve the cutting function. Firstly, the two handles must be brought together, typically by a manual squeezing action. Subsequently, rotary drive must be provided to the drive wheel. The Applicant has appreciated that such requirement for these two separate kinds of actions makes it difficult to fully automate a can opener of this type. Indeed, the GB 2 118 134 A1 document only envisages manual operability.

In solution to this problem, Applicant has now devised a can opener mechanism, which relies only on the provision of rotary drive, preferably to a single drive wheel. Such rotary drive may be provided by manual or automatic (i.e. powered) drive means.

SUMMARY OF THE INVENTION

According to one aspect of the present invention there is provided a mechanism for use in an opener for a can, said can comprising a cylindrical wall closed at each end with a circular lid fixed thereto by means of an upstanding rim around the edge of said lid that clamps onto said each end of said cylindrical wall, said mechanism comprising a body;

rotationally mounting to said body about a first axis, a drive wheel for engaging the rim of the can;

rotationally mounting to said body about a second axis and drivably rotatable by said drive wheel, a cutter wheel;

eccentrically mounting to said cutter wheel, a cutting knife movable on rotation of the cutter wheel to a cutting position in which the cutter knife forms a nip with the drive wheel such that the cutting knife penetrates through the cylindrical wall of the can to provide a cut therein as the opener orbits relatively therearound, wherein said cutting position is defined by a cutting interval corresponding to a segment of rotation of the cutter wheel in which the cutting knife is sufficiently proximal to the drive wheel to form said nip; and provided to the cutter wheel, intermittent drive means for providing intermittent drive between the drive wheel and the cutter wheel when the cutting knife is in the cutting position such as to maintain the nip in place for a sufficient cutting interval to provide a full orbital cut around the cylindrical wall of the can.

There is provided a mechanism for use in a can opener. The can is of the standard type and typically comprises a cylindrical wall closed at both ends with a circular lid fixed to each end by means of an upstanding rim around the edge of said lid clamping onto said each end of said cylindrical wall.

The mechanism comprises a body, the primary function of which is to provide a base or surface for mounting of the drive wheel and cutter wheel. Thus, the body typically defines a relatively simply planar form, which in aspects, may be supplemented by features to accommodate receipt of the can and/or to facilitate ease of use by the user.

Rotationally mounting to said body about a first rotational axis there is provided, a drive wheel for engaging the rim of the can.

Rotationally mounting to said body about a second rotational axis, which is necessarily distinct from the first rotational axis, there is provided a cutter wheel. The cutter wheel is arranged to be drivably rotatable by the drive wheel. Typically, gear teeth of the drive wheel and cutter wheel mesh together directly, although variations are envisaged in which an indirect drive relationship exists.

Eccentrically mounting to the cutter wheel, there is provided a cutting knife. By 'eccentrically mounting' it is meant that the cutting knife mounts to the cutter wheel in eccentric (or 'displaced') fashion relative to the second rotational axis. Typically, the cutting knife is circular in profile, and the eccentric mounting therefore means that as the cutter wheel is rotated, the central point of the circular cutting knife is also rotated about that axis such that the edge of the circular cutting knife is displaced.

In particular, the cutter wheel is rotatable to a cutting position in which the cutter knife is displaced to a position in which it forms a nip with the drive wheel such that in use, the cutting knife penetrates through the cylindrical wall of the can to provide a cut therein as the opener orbits relatively therearound.

The cutting position is defined by a cutting interval corresponding to a segment of rotation of the cutter wheel in which the cutting knife is sufficiently proximal to the drive wheel to form the nip. That is to say, the cutting nip is in place during a segment of rotation of the cutter wheel defined between the point of rotation of the cutting wheel at which the cutting knife is brought close enough to the drive wheel to just form the cutting nip to the point of rotation of the cutting wheel at which the cutting knife moves far enough from the drive wheel for the cutting nip to be broken.

It will be appreciated that in order to fully open the can the cutting action of the cutting knife on the cylindrical wall of the can must remain in place for a cutting interval corresponding to more than just a segment of rotation of the can. Indeed, a cutting interval corresponding to at least a full orbit (i.e. 360 degrees rotation) of the can is required for full opening.

Accordingly there is provided to the cutter wheel, an intermittent drive means for providing intermittent drive between the drive wheel and the cutter wheel when the cutting knife is in the cutting position such as to maintain the nip in place for a sufficient cutting interval to provide the necessary full orbital cut around the cylindrical wall of the can.

In essence, it will be appreciated that the function of the intermittent drive means is to extend the cutting interval to be sufficient to provide the required full orbital cut. The intermittent drive means provides such function by providing only intermittent (e.g. stepped) drive between the drive wheel and the cutter wheel when the cutting knife is in the cutting position. Once the full orbital cut has been provided to the can wall, the cutter wheel rotates on further and beyond the cutting position and the normal (i.e. non-intermittent) drive relationship is restored between the cutter and drive wheels. Suitably, the intermittent drive means comprises a Geneva mechanism or equivalent thereto.

Suitably, the cutter wheel is arranged such that at the cutting position the usual drive relationship between the drive wheel and cutter wheel is disengaged. This is for example, achieved by removing teeth from the segment of the cutter wheel corresponding to the cutting interval (i.e. corresponding to the segment of rotation of the cutter wheel in which the cutting knife is sufficiently proximal to the drive wheel to form the cutting nip).

The required intermittent drive means (that provides the intermittent drive relationship between the drive wheel and the primary drive teeth of the cutter wheel) is suitably achieved by providing the drive wheel with a drive peg (or tooth or equivalent feature) arranged for intermittent drive action with an intermittently drivable element provided to the cutter wheel. Suitably, the intermittently drivable element comprises a curved rack of drive teeth (e.g. a segment of a full circle of intermittent drive teeth) that is suitably positioned on the cutter wheel. Clearly, the drive peg must not interact with the primary drive teeth of the cutter wheel and hence, the drive peg and intermittent drive teeth are suitably arranged for drivable rotation about a rotational plane spaced from the rotational plane of the drive wheel and the cutter wheel. Preferably, however the drive peg and the intermittent drive teeth share the same rotational axis as the drive wheel and cutter wheel respectively.

Preferably, the intermittent drive means is additionally provided with control means to prevent intermittent rotation of the cutter wheel (either backwards or forwards, or preferably both) other than in response to the driving engagement of the drive peg with the intermittent drive teeth. The control means may additionally function to align the drive peg with the intermittent drive teeth to ensure smooth intermittent drive interaction.

Suitably, the control means comprises a control peg (or tooth or equivalent feature) provided to the drive wheel and arranged to be movable to engage/disengage a curved rack of control teeth (e.g. a segment of a full circle of control teeth) provided to the cutter wheel. The engage/disengage movement of the control peg with the curved rack may for example, be achieved by a suitable engage/disengage feature (e.g. one or more cams or other control surface(s)) arranged such that the control peg disengages the curved rack just prior to engagement of the drive peg with the intermittently drivable element and engages the curved rack subsequent thereto.

Where one or more cams are employed to provide the engage/disengage feature these may either be on the same or on a separate rotational axis to the drive wheel. Thus, the cutter wheel never has any free movement, which could for example, otherwise lead to it either not cutting the can or to it becoming un-synchronized with the drive wheel.

Alternatively, the control means comprises a control surface (e.g. an upstanding broken circular wall) provided to the drive wheel and arranged to engage/disengage one or more (e.g. a pair of spaced) control pegs provided to the cutter wheel. The engage/disengage movement of the control surface with the one or more control pegs may for example, be arranged such that the control surface disengages the one or more control pegs just prior to engagement of the drive peg with the intermittently drivable element and engages the one or more control pegs subsequent thereto. Thus, again the cutter wheel never has any free movement, which could for example, otherwise lead to it either not cutting the can or to it becoming un-synchronized with the drive wheel. This type of control mechanism may be regarded as a 'rotating wall Geneva'. An advantage of this approach is its simplicity.

In another aspect, the control means comprises a spacing element provided to the drive wheel and arranged for intermittent spacing interaction with the cutter wheel such as to space the drive peg from the intermittent drive teeth (and hence, prevent any driving action other than at the desired intermittent drive position). Thus, suitably the spacing interaction between the drive peg and intermittent drive teeth is in place until just prior the point of engagement of the drive peg with the intermittently drivable element and the spacing again provided subsequent thereto. Generally, the spacing is provided along the axes of rotation of the drive and cutter wheel.

In one aspect, the spacing element comprises an upstanding curved wall (e.g. a broken circular wall) provided to the drive wheel that is arranged for interaction with the base of the cutter wheel such as to push (i.e. space) the cutter wheel away from (e.g. upwards from) the drive wheel other than at the desired intermittent drive position (e.g. corresponding to the break in the circular wall).

The mechanism herein requires movement of the cutter wheel to a cutting position in which the cutter knife forms a nip with the drive wheel. It is desirable that the nip is as effective as possible.

Suitably, a spacer washer is therefore provided to the cutter wheel, which spacer washer shares the same second axis of rotation. The spacer washer is provided with a connector for connecting to the cutter wheel such that both may rotate together during the cutting action. The spacer washer is typically fashioned of resilient material e.g. rubber or a suitable synthetic polymer. Use of such a resilient material provides for a wider tolerance of grip. This in turn, enables the cutting segment angle to be maximized.

Suitably, the connector of the spacer washer comprises an upstanding non-circular (e.g. square-shaped) spigot arranged to project into a corresponding non-circular (e.g. square-shaped) hole provided to the cutter wheel.

According to a further aspect of the present invention there is provided a can opener comprising the mechanism described above and drive means for driving the drive wheel thereof. The can opener typically comprises a housing shaped for receipt of the can and/or providing features facilitating user operability. Thus, for example, grip features may be provided to facilitate manual handling.

In one aspect, the drive means is adapted for manual drive and may include any suitable means of manually providing rotary drive to the drive wheel. In another aspect, the drive means is adapted for automated (i.e. powered drive) and may include any suitable means of automatically providing rotary drive to the drive wheel.

Suitable manual or automatic drive means may provide drive directly or may transfer drive through any suitable gearing (e.g. through a gear box) or any component/apparatus arranged to provide mechanical advantage (e.g. lever, cam or pulley).

Suitable automated drive means may be powered by any suitable motor or engine, but typically are powered by an electric motor, which may be mains or battery powered.

Initial actuation of the drive means is preferably arranged to rotate the cutter wheel to the cutting position in which the cutting knife penetrates through the cylindrical wall of the can, further actuation of the drive means being arranged to rotate the drive wheel to cause the opener to orbit around the can to form the cut therein.

Yet further actuation of the drive means is preferably arranged to rotate the cutter wheel away said cutting position following completion of the cut.

According to a further aspect of the present invention there is provided the use of the can opener described herein for removing the lid of a can.

BRIEF DESCRIPTION OF THE DRAWINGS

Embodiments of the present invention will now be described with reference to the accompanying drawings in which.

DETAILED DESCRIPTION OF THE PREFERRED EMBODIMENTS

Figure 1:
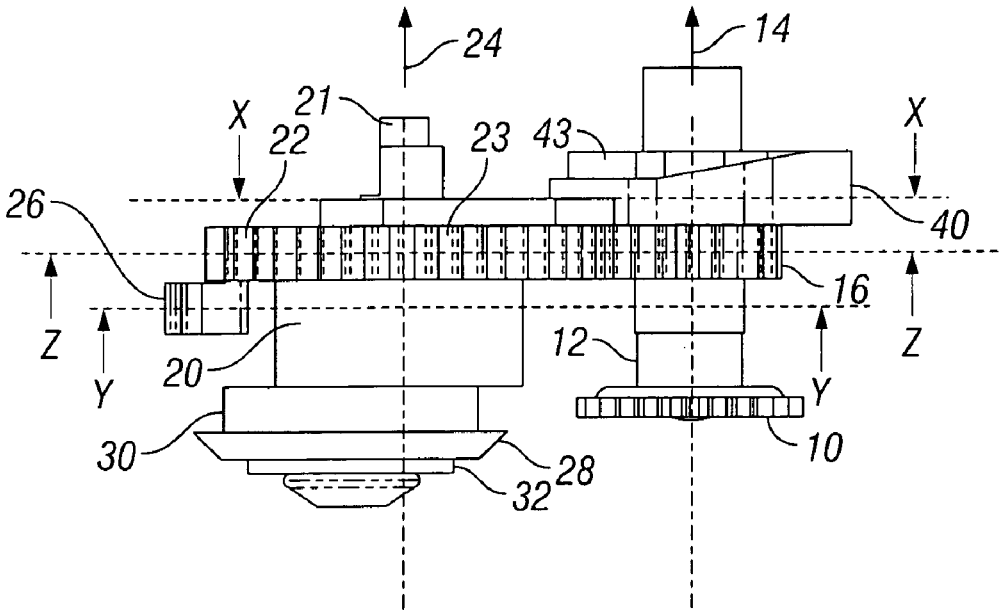
FIG. 1 shows a side view of a first can opener mechanism herein in the start (i.e. can disengaged) position.
Figure 2:
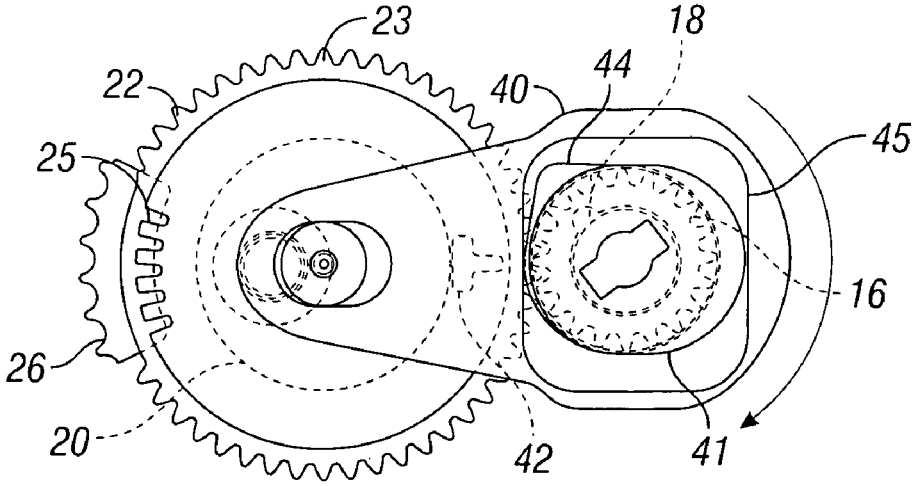
FIG. 2 shows a sectional view along Section X-X of FIG. 1.
Figure 3:
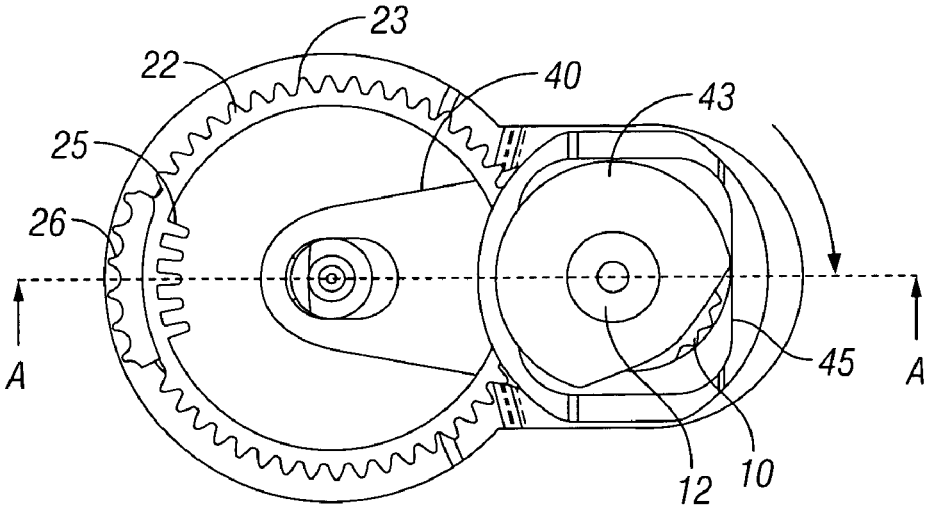
FIG. 3 shows a top view of the first can opener mechanism of FIG. 1 in the start (i.e. can disengaged) position and its interaction with a can.

Referring now to the drawings, at FIGS. 1 to 4 there is shown a first can opener mechanism herein in the start (i.e. can disengaged) position. The mechanism comprises toothed drive wheel 10 mounted on drive spindle 12 arranged for rotation about drive axis 14. Also mounted on drive spindle 12 is drive gear 16, which is arranged to mesh with outer gear teeth 23 of the cutter drive gear 22 provided to cutter wheel 20 for drivable rotation thereof on cutter spindle 21 about cutter wheel axis 24. As shown in FIG. 2, on the left hand side of the cutter drive gear 22 several outer gear teeth 23 are missing and replaced by inner gear teeth 25 and upstanding curved rack of teeth 26, the function of both of which will become clearer from the later description.

The cutter wheel 20 is further provided with a circular cutting knife 28, which eccentrically mounts thereto such that as the cutter wheel rotates about its axis 24 the cutting knife 28 is brought into close proximity with drive wheel 10 to form a nip therebetween. The formation of this nip in use corresponds to a cutting position in which the cutting knife 28 penetrates through the cylindrical wall 2 of a can 1 (see FIG. 4) to provide a cut therein as the opener orbits relatively therearound. As will again be appreciated from the later description, the cutting position is defined by a cutting interval corresponding to a segment of rotation of the cutter wheel 20 in which the cutting knife 28 is sufficiently proximal to the drive wheel 10 to form the nip.

Figure 4:
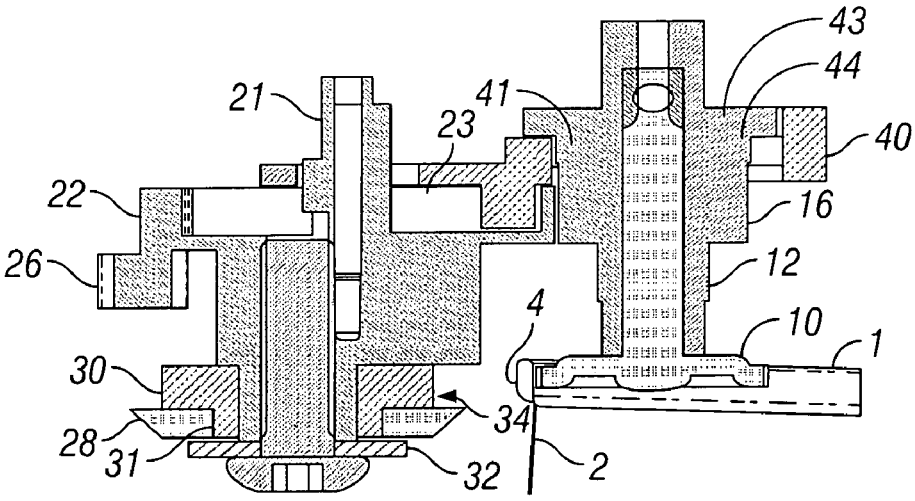
FIG. 4 shows a sectional view along Section A-A of FIG. 3.
Figure 5A:
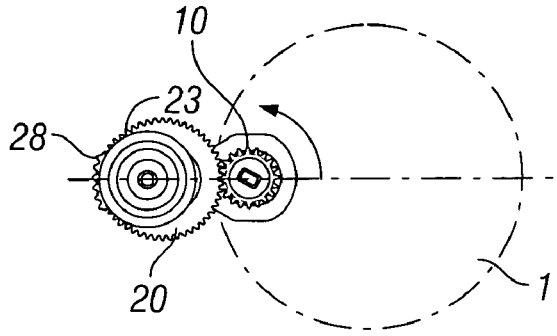
FIGS. 5*a* to 5*g* show views from underneath of the first can opener mechanism of FIG. 1 and its interaction with a can during sequential parts of a can opening operation.
Figure 6A:
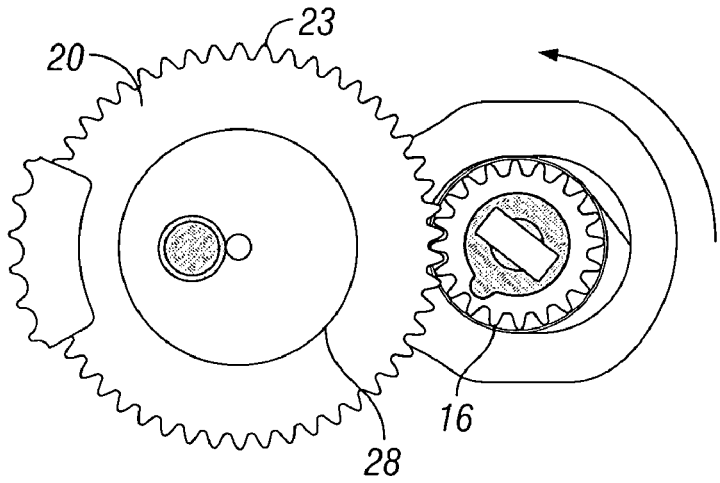
FIGS. 6*a* to 6*g* show sectional views from underneath taken along Section Y-Y of the first can opener mechanism of FIG. 1 and its interaction with a can during sequential parts of a can opening operation.
Figure 7A:
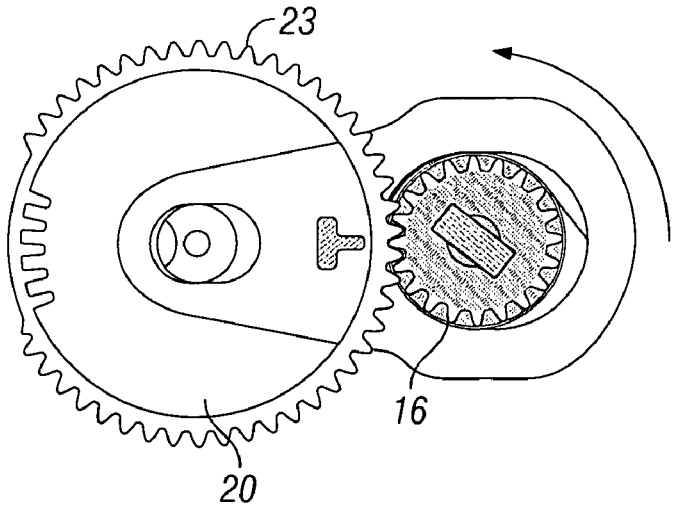
FIGS. 7*a* to 7*g* show sectional views from underneath taken along Section Z-Z of the first can opener mechanism of FIG. 1 and its interaction with a can during sequential parts of a can opening operation.
Figure 5B:
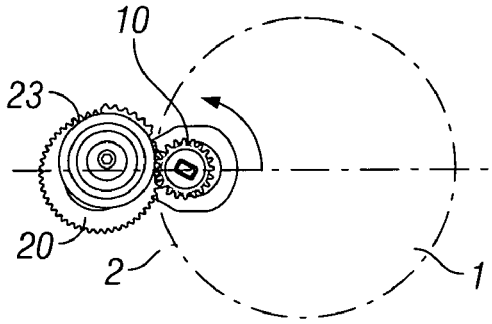
Figure 6B:
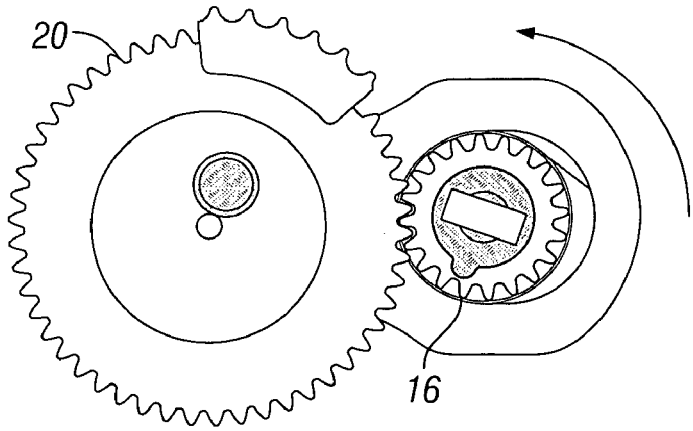
Figure 7B:
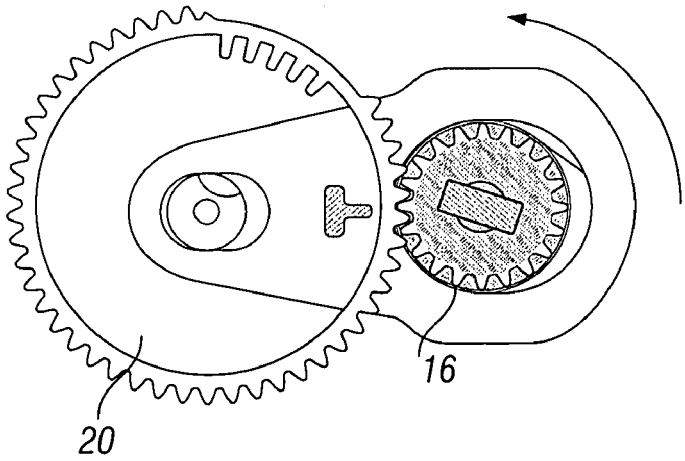
Figure 5C:
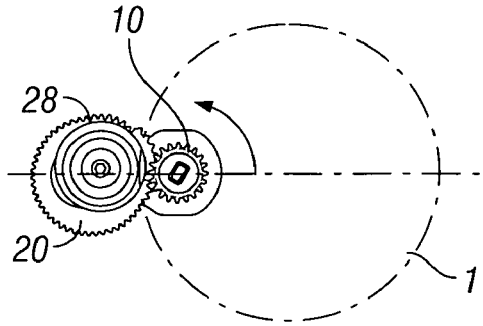
Figure 6C:
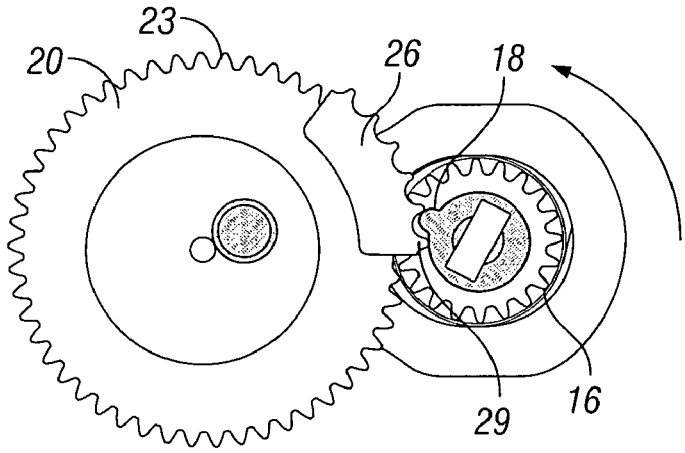
Figure 7C:
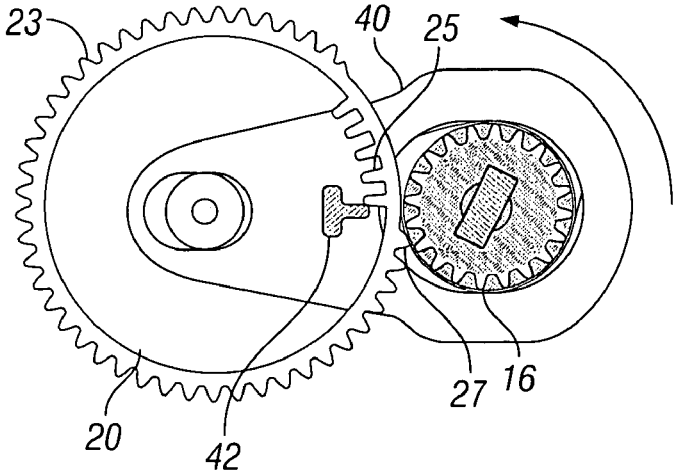
Figure 5D:
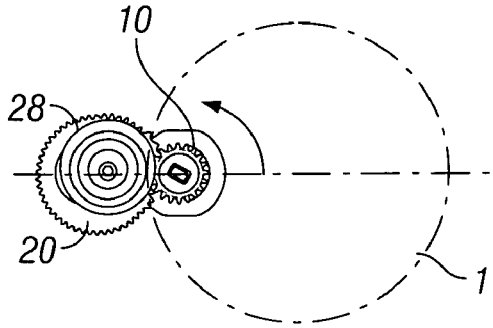
Figure 6D:
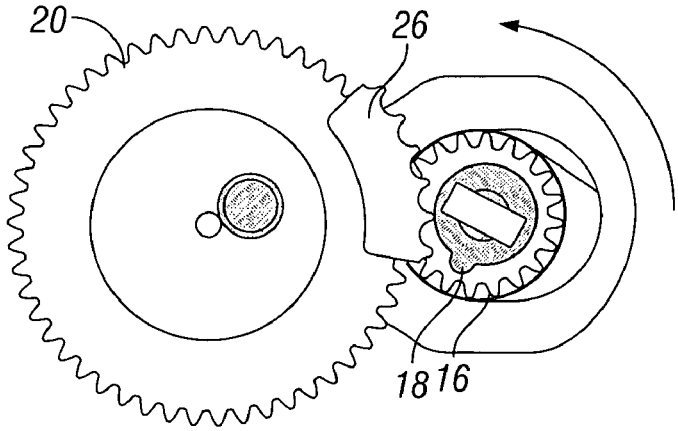
Figure 7D:
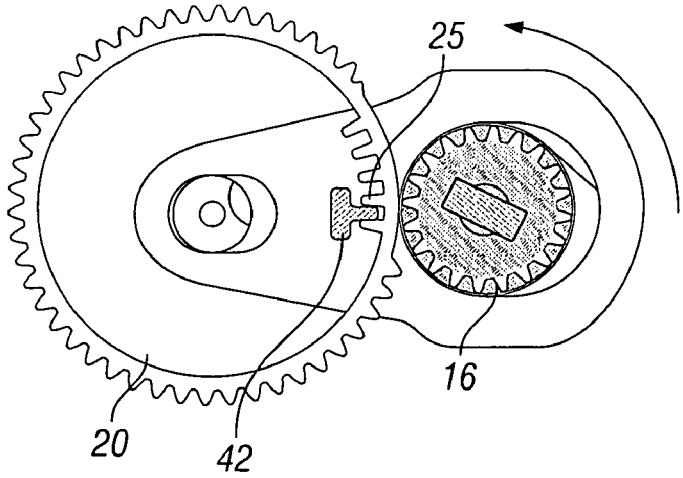
Figure 5E:
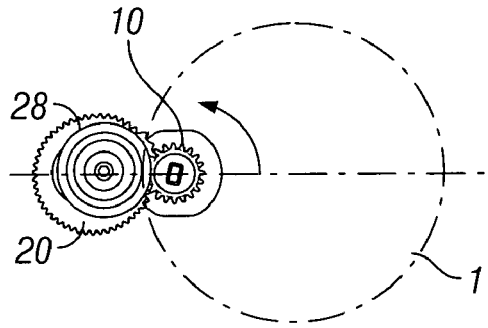
Figure 6E:
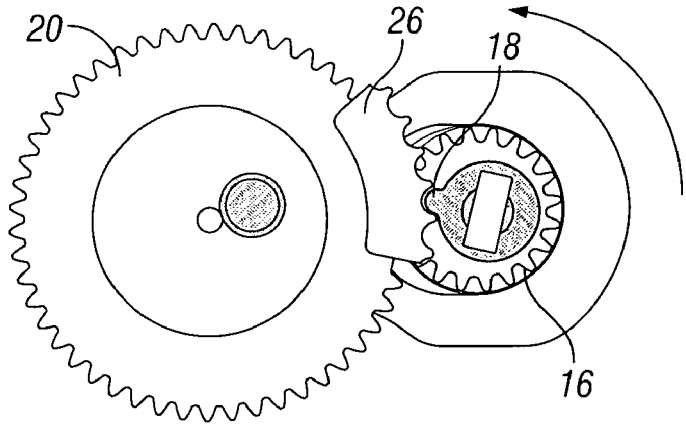
Figure 7E:
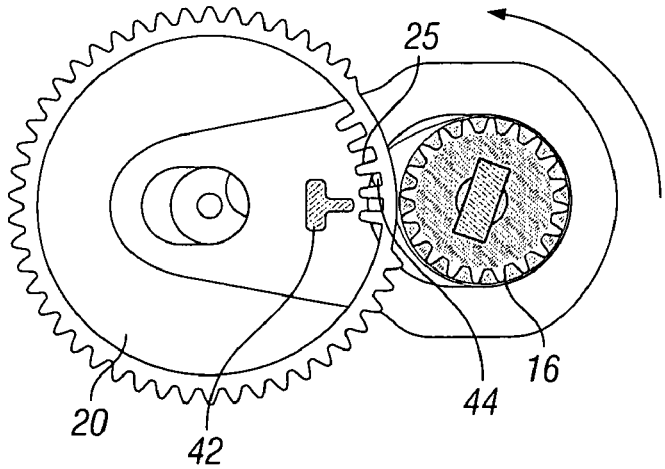
Figure 5F:
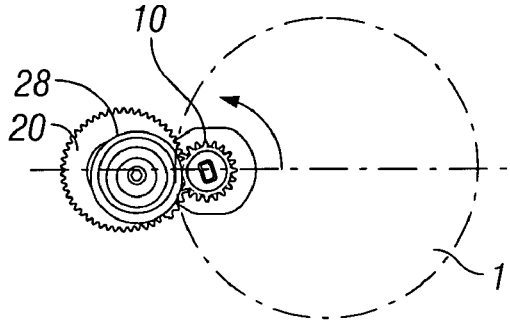
Figure 6F:
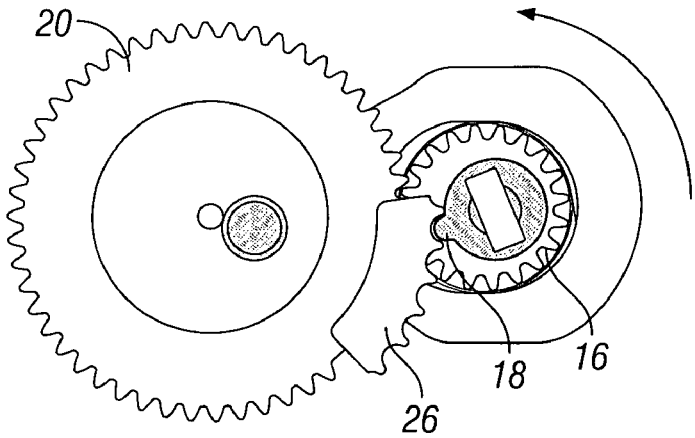
Figure 7F:
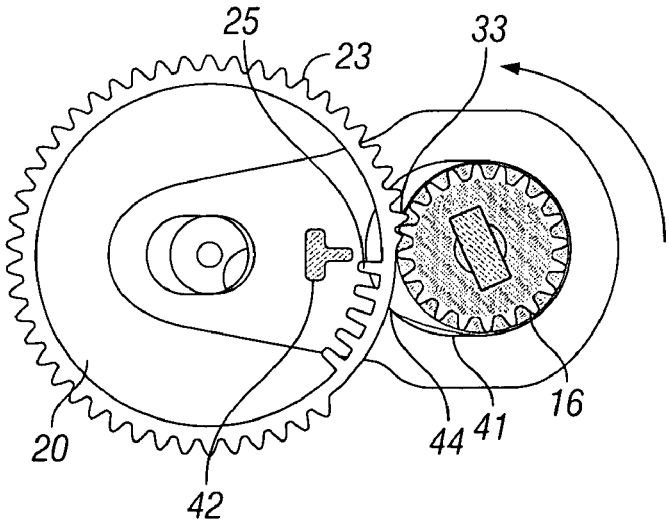
Figure 5G:
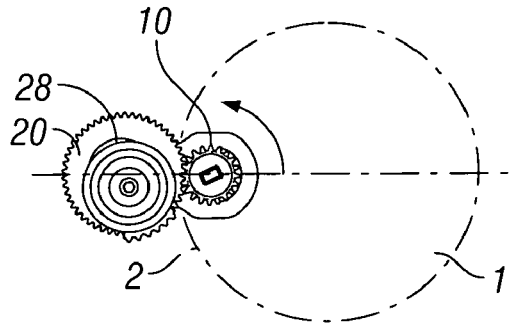
Figure 6G:
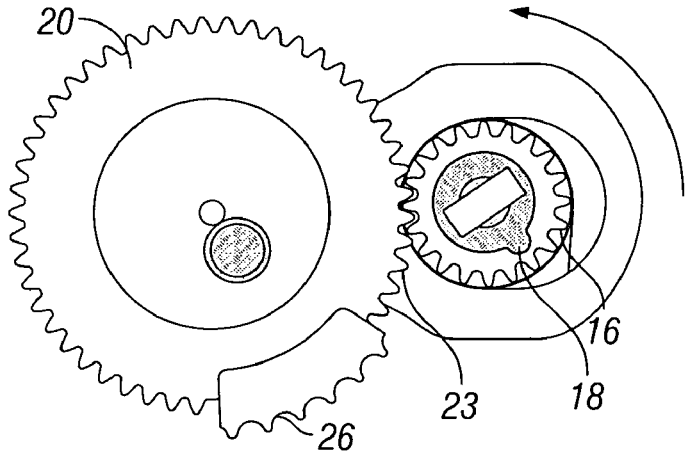
Figure 7G:
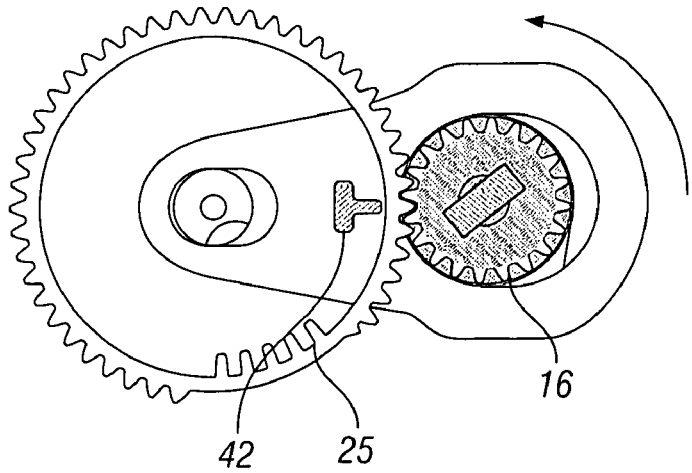

As best seen at FIGS. 1 and 4, spacer washer 30 and connector 31 therefor are provided to the cutter wheel 20 wherein both share axis of rotation 24 with the cutter wheel 20. The connector 31 comprises an upstanding non-circular spigot, which projects into a corresponding non-circular hole provided to the cutting knife 28 and is topped by end washer 32. The function of the spacer washer 30 is primarily to provide a cavity 34 for receipt of the protruding lid 4 of the can. Applicant has found that gripping of the can is improved wherein the spacer washer 30 comprises a resilient material (e.g. rubber or a synthetic polymer).

The cutter wheel 20 is further provided with intermittent drive means for providing intermittent drive between the drive wheel 10 and the cutter wheel 20 when the cutting knife 28 is in the cutting position such as to maintain the nip in place for a sufficient cutting interval to provide a full orbital cut around the cylindrical wall 2 of the can 1.

The intermittency of drive is essentially provided by the gap ('missing teeth') in the outer gear teeth 23 of the cutter drive gear 22, which causes a break in the meshed interaction with the drive gear 16 of the drive wheel 10. At that point, drive peg 18 is brought into interaction with the upstanding curved rack of teeth 26 such that for each rotation of the drive wheel 10 the cutter wheel 20 is 'kicked on' on by one tooth of the curved rack 26. Ultimately, the cutter wheel 20 gets 'kicked on' sufficiently that the drive gear 16 again meshes with the outer gear teeth 23 of the cutter drive gear 22 thereby resuming the normal drive relationship between drive wheel 10 and cutter wheel 20. The intermittent drive may thus, be appreciated to be a kind of Geneva mechanism. For effective working of the opener it will be appreciated that the period of intermittent drive must correspond essentially to the cutting interval required to provide a full orbital cut around the cylindrical wall 2 of the can 1.

In an improvement to the basic intermittent drive means, there is further provided a control function to control (i.e. hold still) the cutter wheel 20 during the cutting interval. Thus, as shown at FIG. 2, control bar 40, which mounts to both the drive spindle 12 and cutter spindle 21 (and is laterally movable with respect thereto) is provided with a control peg 42 that meshes intermittently during the cutting interval with the inner gear teeth 25 of the cutter wheel 20. In more detail, control peg 42 is arranged to engage/disengage the inner gear teeth 25 on the cutter wheel 20. The engage/disengage movement of the control peg 42 with the inner gear teeth 25 is achieved by interaction of two cams 43, 44. These are cam 44, which disengages control peg 42 with an inner face 41 of the control bar 40 and cam 43, which engages control peg 42, by interaction with wall 45. The cam 43 may, in embodiments, be replaced by a spring. The set up is arranged such that the control peg 42 disengages the inner gear teeth 25 just prior to engagement of the drive peg 18 with the upstanding curved rack of teeth 26 of the intermittent drive means. Thus, the cutter wheel 20 never has any free movement, which could for example, otherwise lead to it either not cutting the can 1 or to it becoming un-synchronized with the drive wheel 10.

The function of the intermittent drive means and its associated control means may be better understood by reference to FIGS. 5*a* to 5*g*; 6*a* to 6*g*; and 7*a* to 7*g*, which show sequential steps in a can opening action. For simplicity, only the relevant 'active' features of each drawing are labeled.

FIGS. 5*a*-7*a* show the can 1 opening mechanism of FIGS. 1 to 4 in the start position, in which the circular cutting knife 28 of the cutter wheel 20 is fully separated from the drive wheel 10 such that no nip is formed therebetween. The outer gear teeth 23 of the cutter wheel 20 mesh with the drive wheel 10 to allow for normal drivable rotation of the cutter 20 by the drive wheel.

At FIGS. 5*b*-7*b*, the drive wheel 10 has been rotated to drivably rotate the cutter wheel 20 to bring the cutting knife 28 into proximity with the drive wheel 10 and thereby form a nip therebetween for gripped receipt of the wall 2 of the can 1 . This position thus, corresponds to just prior to the start of the cutting interval.

At FIGS. 5*c*-7*c*, the drive wheel 10 has rotated further and beyond the last tooth 27 of the outer gear teeth 23 such that the normal drive interaction between the drive wheel 10 and those outer gear teeth 23 of the cutter wheel 20 is broken. This corresponds to the start of the cutting interval and the intermittent drive mechanism now comes into play. As shown at FIG. 6*c*, drive peg 18 is brought into meshed relationship with the first tooth 29 of the upstanding curved rack of teeth 26. Additionally, control peg 42 on the control bar 40 interacts with the inner gear teeth 25 of the cutter wheel 20 to control (e.g. lock) any undesirable motion thereof.

At FIGS. 5*d*-7*d*, the drive wheel 10 has rotated still further but this rotation results in no rotational drive of the cutter wheel 20 because the drive peg 18 is no longer in meshed relationship with the upstanding curved rack of teeth 26. Additionally, the locked interaction between control peg 42 and the inner gear teeth 25 of the cutter wheel 20 locks any undesirable motion thereof.

At FIGS. 5*e*-7*e*, the drive wheel 10 has rotated to again bring the drive peg 18 into drivable meshed relationship with the upstanding curved rack of teeth 26 such that further rotation of the drive wheel 10 results in 'kick on' rotation of the cutter wheel 20. Just before this 'kick on' action occurs the engagement between control peg 42 and the inner gear teeth 25 of the cutter wheel 20 is broken in response to the action of cam 44 acting on the inner face 41 of the control bar 40, which pushes the control bar 40 away from the drive wheel 10 to disengage the control peg from the inner gear teeth 25, thereby allowing for the desired 'kick on' movement of the cutter wheel 20.

FIGS. 5*f*-7*f*, show the position of the mechanism at the end of the cutting interval (i.e. right at the end of the intermittent drive period and just before disengagement of the cutting knife 28 from its cutting interaction with the can 1). The drive wheel 10 has rotated still further to bring the drive peg 18 into drivable meshed relationship with the final tooth of upstanding curved rack of teeth 26 such that further rotation of the drive wheel 10 results in one last 'kick on' rotation of the cutter wheel 20. As before, to enable this 'kick on' action to occur the control peg 42 and the inner gear teeth 25 of the cutter wheel 20 is disengaged (again in response to the action of cam 44 acting on the inner rim 41 of the control bar 40). Now however, the drive gear 16 is again brought into meshed relationship with the first tooth 33 of the outer gear teeth 23 such that the normal drive relationship between the drive wheel 10 and cutter wheel 20 may be resumed as is shown in FIGS. 5*g*-7*g*.

FIGS. 5*g*-7*g* thus, correspond to the position after the end of the cutting interval. The cutting knife 28 is moved away from the wall 2 of the can 1 and the nip with the drive wheel 10 is about to be broken such that the can 1 (with lid cut away therefrom) may be removed from the cutter mechanism.

Figure 8:
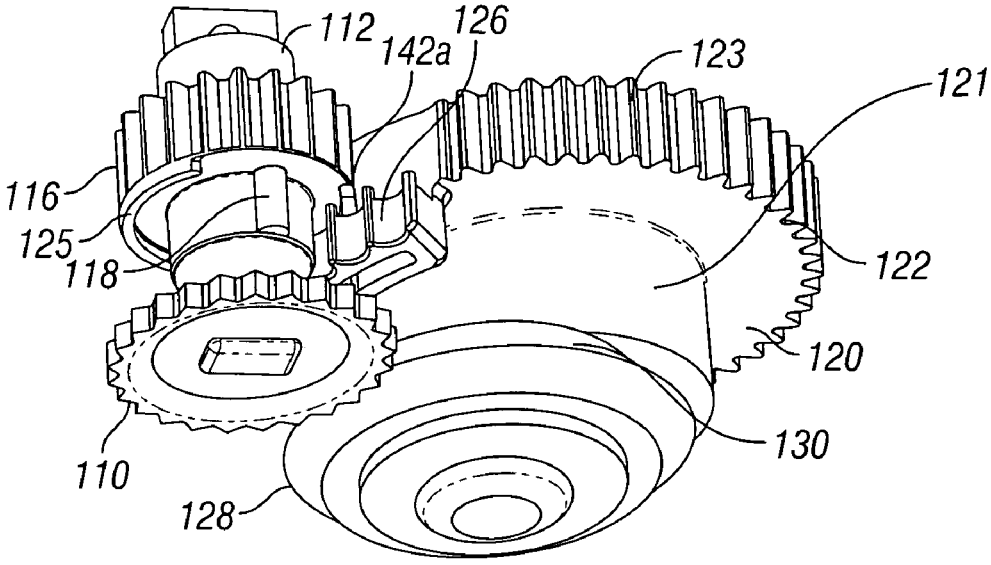
FIG. 8 shows a perspective view from below of a second can opener mechanism herein in the cutting (i.e. can engaged) position.
Figure 9:
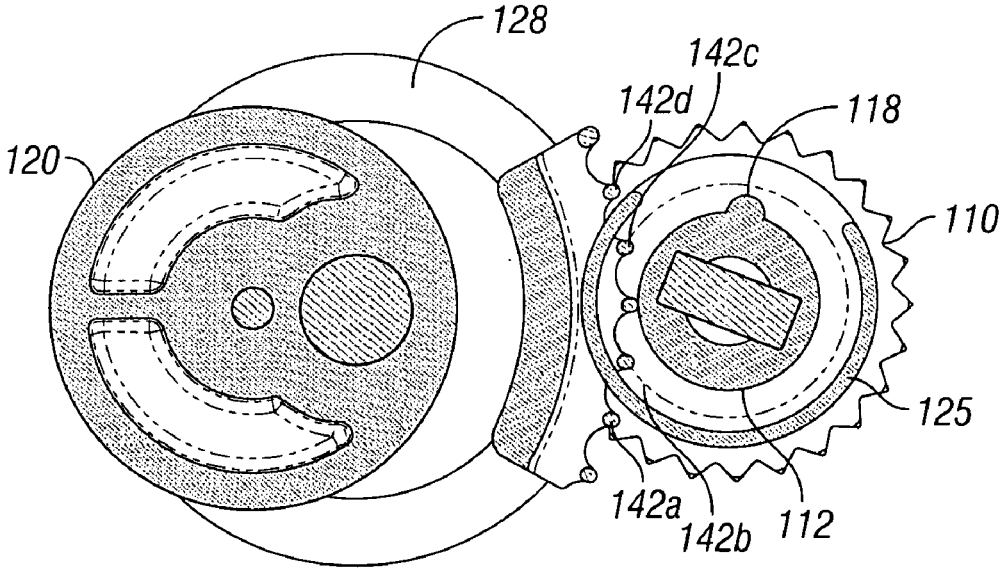
FIG. 9 shows a sectional view looking downwards towards the drive wheel of the second can opener mechanism herein in the cutting (i.e. can engaged) position.

FIGS. 8 and 9 show a second can opener mechanism herein, in which the basic intermittent drive mechanism corresponds to that of the first can opener mechanism of FIGS. 1 to 7*g* but where an alternative control mechanism is employed.

Thus, at FIGS. 8 to 9 there is shown the second can opener mechanism herein in the cutting position. The mechanism comprises toothed drive wheel 110 mounted on drive spindle 112 arranged for rotation about a drive axis. Also mounted on drive spindle 112 is drive gear 116, which is arranged to mesh with outer gear teeth 123 of the cutter drive gear 122 provided to cutter wheel 120 for drivable rotation thereof on cutter spindle 121 about a cutter wheel axis. It may be seen at FIG. 8 that on the left hand side of the cutter drive gear 122 several outer gear teeth 123 are missing and replaced by upstanding curved rack of teeth 126 corresponding to this same feature of the first can opener mechanism.

Again, the cutter wheel 120 is provided with a circular cutting knife 128, which eccentrically mounts thereto such that as the cutter wheel rotates about its axis the cutting knife 128 is brought into close proximity with drive wheel 110 to form a nip therebetween. The formation of this nip in use corresponds to a cutting position in which the cutting knife 128 penetrates through the cylindrical wall of a can to provide a cut therein as the opener orbits relatively therearound. Again, the cutting position is defined by a cutting interval corresponding to a segment of rotation of the cutter wheel 120 in which the cutting knife 128 is sufficiently proximal to the drive wheel 110 to form the nip. Spacer washer 130 is also provided to the cutter wheel and has the identical function to that of the first can opener mechanism.

The cutter wheel 120 is again also provided with intermittent drive means for providing intermittent drive between the drive wheel 110 and the cutter wheel 120 when the cutting knife 128 is in the cutting position such as to maintain the nip in place for a sufficient cutting interval to provide a full orbital cut around the cylindrical wall of the can.

The intermittency of drive is essentially provided by the gap ('missing teeth') in the outer gear teeth 123 of the cutter drive gear 122, which causes a break in the meshed interaction with the drive gear 116 of the drive wheel 110. At that point, drive peg 118 is brought into interaction with the upstanding curved rack of teeth 126 such that for each rotation of the drive wheel 110 the cutter wheel 120 is 'kicked on' on by one tooth of the curved rack 126. Ultimately, the cutter wheel 120 gets 'kicked on' sufficiently that the drive gear 116 again meshes with the outer gear teeth 123 of the cutter drive gear 122 thereby resuming the normal drive relationship between drive wheel 110 and cutter wheel 120.

In an improvement to the basic intermittent drive means, there is further provided a control function to control (i.e. hold still) the cutter wheel 120 during the cutting interval. The control function is provided an upstanding broken circular wall 125 (which forms a control surface) provided to the drive wheel 110 and arranged to engage/disengage several spaced control pegs 142*a-d* provided to the cutter wheel 120. In more detail, two of these pegs 142*a*, 142*d* are outside the wall 125 and two pegs 142*b*, 142*c* inside the wall. The interaction of various pairings of pegs (e.g. 142*a* and 142*b*; 142*b* and 142*c*; 142*c* and 142*d*; or 142*d* and 142*a*) with the curved wall 125 on the drive wheel can provide the desired engagement of the cutter wheel 120. The engage/disengage movement of the broken circular wall 125 with the several control pegs 142*a-d* is arranged such that the wall 125 disengages the several control pegs 142*a-d* just prior to engagement of the drive peg 118 with the curved rack 126 and engages the several control pegs 142*a-d* subsequent thereto. Thus, again the cutter wheel 120 never has any free movement, which could for example, otherwise lead to it either not cutting the can or to it becoming un-synchronized with the drive wheel 110. This type of control mechanism may be regarded as a 'rotating wall Geneva'.

Figure 10:
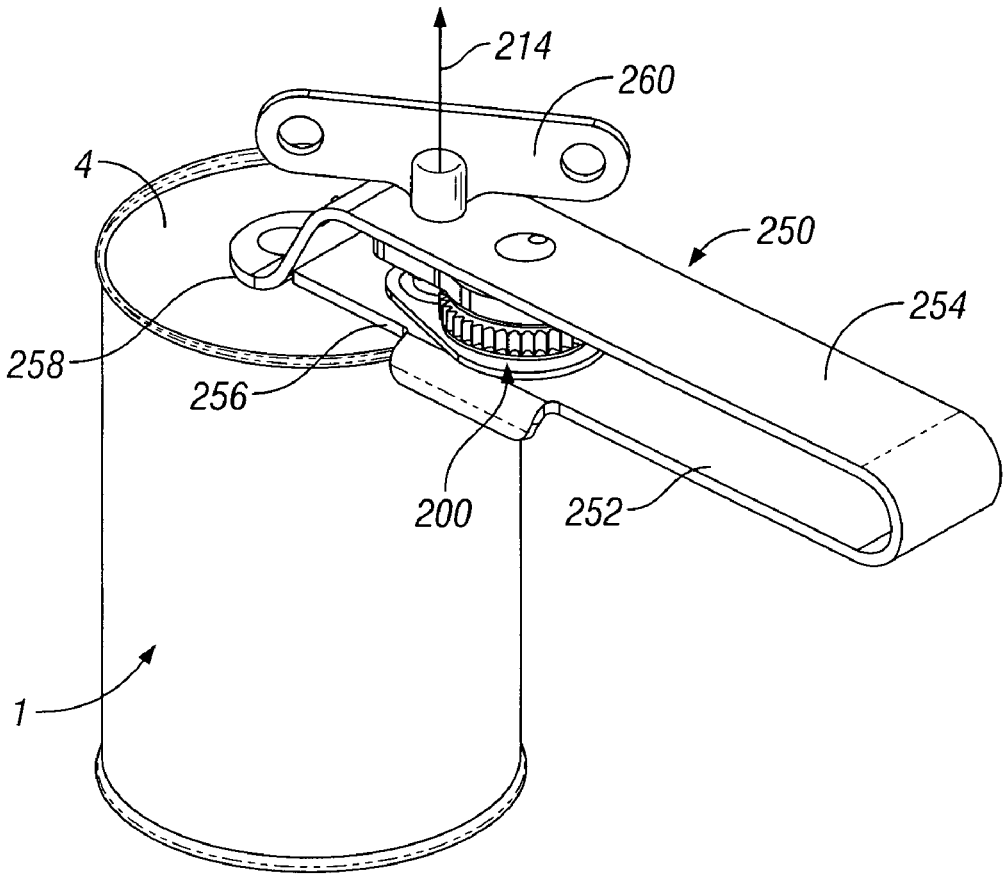
FIG. 10 shows a can opener including the can opener mechanism herein and its interaction with a can.
Figure 11A:
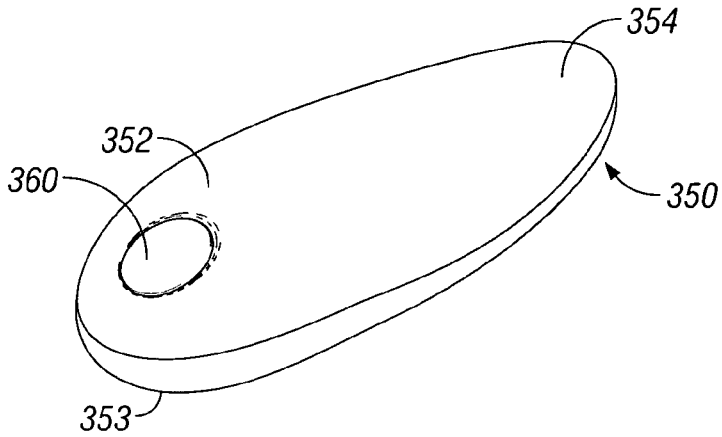
FIGS. 11*a* and 11*b* respectively show perspective top and bottom views of an automatic can opener including the can opener mechanism herein.
Figure 11B:
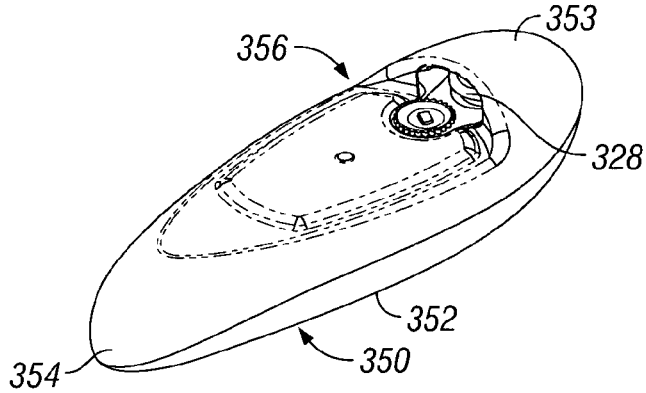
Figure 12:
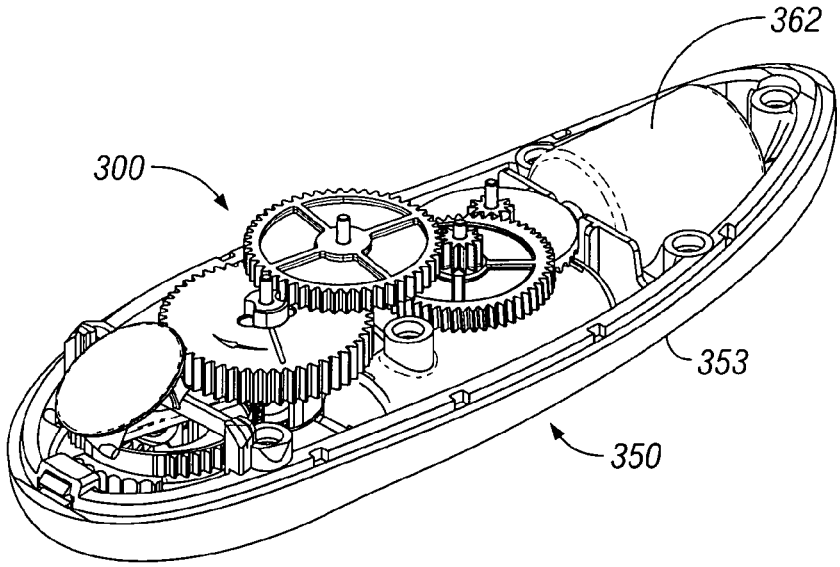
FIG. 12 shows a perspective view of the automatic can opener of FIGS. 11*a* and 11*b* with its top housing portion removed.
Figure 13:
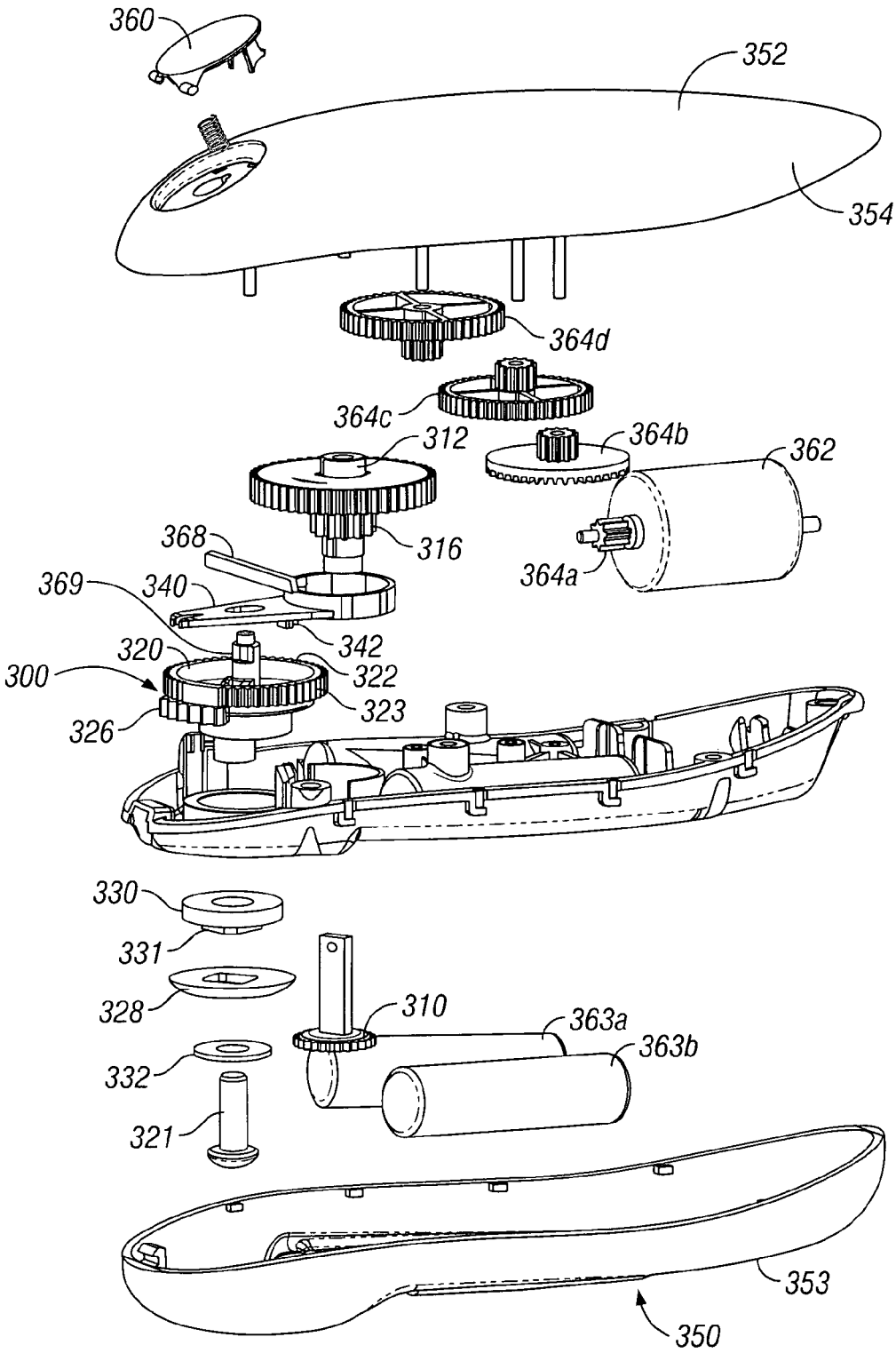
FIG. 13 shows an exploded view of the automatic can opener of FIGS. 11*a* and 11*b*.

FIG. 10 shows a manual can opener 250 herein, which may incorporate either the first or second can opener mechanisms as described with reference to the earlier drawings.

The can opener 250 comprises a body 252 defining a handle 254; a jaw 256 for receipt of the lid 4 part of a can 1; and a support part 258 for resting on the lid 4. The can opener mechanism 200 sits within a cavity defined by the body 252. Twist handle 260 is mounted for rotation on the drive axis 214 such that rotation thereof results in rotational drive being provided to the drive wheel of the can opener mechanism 200. This version of the can opener 250 has an open body 252. In variations, a closed or semi-closed body with mechanism 200 inside is also possible. The body 252 can be comprised of any suitably rigid material (e.g. thermoplastics to metals) to house and space the mechanism 200 and is suitably designed to be ergonomic in use.

FIGS. 11*a* to 13 show different views of an automatic can opener 350 herein, incorporating the first can opener mechanism 300 as described with reference to the earlier drawings. In alternative embodiment, the second can opener mechanism of FIGS. 8 and 9 is substituted. This version of the automatic can opener 350 may be placed onto a can 1, and once started (by button 360), brings the cutter wheel to the cutting position, in which the cutting knife penetrates through the cylindrical wall of the can, the drive means then rotates the drive wheel to cause the opener to orbit around the can to form the cut therein.

After one rotation, the lid 4 is cut and the cutter wheel is moved out of its cutting position. The auto can opener 350 can then be lifted off, and the now cut lid 4 can also be lifted off.

The automatic can opener 350 comprises a cigar-shaped body (in variations, other shapes are possible) formed by mating top 352 and bottom 353 body parts and defining a handle 354 for the user's grip. The top body part 352 has sprung power button 360 provided thereto, which may be used to actuate drive motor 362, which is powered by batteries 363*a*, 363 *b* for automatic operation of the opener mechanism. The bottom part 353 is shaped for receipt of the lid part of a can (not shown) within jaw 356. Protruding into the jaw 356 may be seen drive wheel 310 and circular cutting knife 328, which in a cutting operation form a cutting nip at the can.

In use, drive motor 362 provides drive to the can opener mechanism 300 at drive wheel 310 through gear train 364*a-c*. The drive motor 362 is responsive to actuation of the power button 360, which in turn can directly operate switch contact 368 (or in an alternative, indirectly e.g. with a micro switch). The can opener 350 is arranged to switch off automatically at the end of a can opening operation by the action of stop cam 369 mounted at the cutter wheel 320. Other sensors or switches may be provided e.g. to prevent start when can 1 is not present; or when the lower body part 353 has been removed for cleaning etc. The drive motor 362 may alternatively be controlled by other logic e.g. microprocessor etc. to provide extra functions such as speeding up the entry and exit phases of the cycle; triggering two or more cycles for larger cans; monitoring battery status; monitoring current consumption; and/or sensing end of cutting operation.

The essential features of the can opener mechanism correspond to those described in detail with reference to FIGS. 1 to 7*g*. Thus, the mechanism comprises toothed drive wheel 310 mounted on drive spindle 312 arranged for rotation about a drive axis. Also mounted on drive spindle 312 is drive gear 316, which is arranged to mesh with outer gear teeth 323 of the cutter drive gear 322 provided to cutter wheel 320 for drivable rotation thereof on cutter spindle 321 about a cutter wheel axis. On part of the cutter drive gear 322 several outer gear teeth 323 are missing and replaced by inner gear teeth (not visible) and upstanding curved rack of teeth 326.

Cutter wheel 320 is provided with a circular cutting knife 328, which eccentrically mounts thereto such that as the cutter wheel rotates about its axis the cutting knife 328 is brought into close proximity with drive wheel 310 to form a nip therebetween. The formation of this nip in use corresponds to a cutting position in which the cutting knife 328 penetrates through the cylindrical wall of a can to provide a cut therein as the opener orbits relatively therearound. Again, the cutting position is defined by a cutting interval corresponding to a segment of rotation of the cutter wheel 320 in which the cutting knife 328 is sufficiently proximal to the drive wheel 310 to form the nip. Spacer washer 330 with square spigot connector 331 and end washer 332 are provided to the cutter wheel and have the identical function to that of the first can opener mechanism. Also visible is control bar 340, which mounts to both the drive spindle 312 and cutter spindle 321 (and is laterally movable with respect thereto) is provided with a control peg 342 that meshes intermittently during the cutting interval with the inner gear teeth (not directly seen in FIG. 13) of the cutter wheel 320 (as described earlier).

An additional spring loaded gear or worm gear may be provided, in the gear train 364*a-c* before drive wheel 310, which can be used by compressing spring to engage and to manually rotate the mechanism in case of stalling due to low battery.

While the preferred embodiments of the invention have been shown and described, it will be understood by those skilled in the art that changes of modifications may be made thereto without departing from the true spirit and scope of the invention.

We claim:

1. A can opener for use with a can comprising a cylindrical wall closed at an end with a circular lid fixed thereto by means of an upstanding rim around the edge of the lid that clamps onto the end of the cylindrical wall, the can opener comprising: a body; a drive wheel for engaging the rim of the can; means for mounting said drive wheel to said body such that said drive wheel is rotatable about a first axis; a cutter wheel; means for mounting said cutter wheel to said body such that said cutter wheel is drivably rotatable about a second axis by said drive wheel; means for mounting a cutting knife to said cutter wheel, said cutting knife moveable on rotation of said cutter wheel to a cutting position in which the cutter knife forms a nip with the drive wheel such that the cutting knife penetrates through the cylindrical wall of the can to provide a cut therein as the opener orbits relatively therearound, wherein said cutting position is defined by a cutting interval corresponding to a segment of rotation of the cutter wheel in which the cutting knife is sufficiently proximal to the drive wheel to form said nip; and intermittent drive means for providing intermittent drive between the drive wheel and the cutter wheel when the cutting knife is in the cutting position to maintain the nip in place for a sufficient cutting interval and to provide a full orbital cut around the cylindrical wall of the can.

2. A can opener according to claim 1, wherein the drive wheel and the cutter wheel are in a direct drive relationship.

3. A can opener according to claim 1, wherein the cutting knife has circular form.

4. A can opener according to claim 1, wherein the intermittent drive means comprises a Geneva mechanism.

5. A can opener according to claim 1, wherein at the cutting position the usual drive relationship between the drive wheel and the cutter wheel is disengaged.

6. A can opener according to claim 5, wherein the cutter wheel has missing teeth at the segment thereof corresponding to the cutting interval.

7. A can opener according to claim 1, wherein the intermittent drive means comprises a drive peg on the drive wheel arranged for intermittent drive action with an intermittently drivable element on the cutter wheel.

8. A can opener according to claim 7, wherein the intermittently drivable element comprises a curved rack of intermittent drive teeth on the cutter wheel.

9. A can opener according to claim 8, wherein the drive peg and said intermittent drive teeth are rotational about a rotational plane spaced from the rotational plane of the drive wheel and the cutter wheel.

10. A can opener according to claim 9, wherein the drive peg and the intermittent drive teeth share the same rotational axis as the drive wheel and the cutter wheel respectively.

11. A can opener according to claim 1, wherein the intermittent drive means is provided with control means to prevent intermittent rotation of the cutter wheel other than in response to the driving engagement of a drive peg with a set of intermittent drive teeth.

12. A can opener according to claim 11, wherein the control means additionally functions to align the drive peg with the intermittent drive teeth to ensure smooth intermittent drive interaction.

13. A can opener according to claim 11, wherein the control means comprises a control peg provided to the drive wheel and arranged for movement to engage/disengage a curved rack of control teeth provided to the cutter wheel.

14. A can opener according to claim 13, wherein the movement to engage/disengage the control peg and said curved rack of control teeth is under the control of one or more cams.

15. A can opener according to claim 11, wherein the control means comprises a control surface provided to the drive wheel and arranged to engage/disengage one or more control pegs provided to the cutter wheel.

16. A can opener according to claim 15, wherein the control surface comprises an upstanding broken circular wall and a pair of spaced control pegs is provided to the cutter wheel.

17. A can opener according to claim 11, wherein the control means comprises a spacing element provided to the drive wheel and arranged for intermittent spacing interaction with the cutter wheel such as to space the drive peg from the intermittent drive teeth.

18. A can opener according to claim 17, wherein the spacing element comprises an upstanding curved wall provided to the drive wheel and arranged for interaction with the base of the cutter wheel such as to push the cutter wheel away from the drive wheel other than at the intermittent drive position.

19. A can opener according to claim 1, wherein a spacer washer is therefore provided to the cutter wheel, which spacer washer shares the second axis of rotation.

20. A can opener according to claim 19, wherein the spacer washer is provided with a connector for connecting to the cutter wheel to enable rotation together during the cutting action.

21. A can opener according to claim 20, wherein the connector comprises an upstanding non-circular spigot arranged to project into a corresponding non-circular hole provided to the cutting knife.

22. A can opener according to claim 21, wherein said upstanding non-circular spigot and said corresponding non-circular hole are square-shaped.

23. A can opener according to claim 19, wherein the spacer washer comprises a resilient material selected from the group consisting of rubber or a synthetic polymer.

24. A can opener according to claim 1, further comprising drive means for driving the drive wheel thereof.

25. A can opener according to claim 24, further comprising a housing.

26. A can opener according to claim 24, wherein the drive means is adapted for manual drive.

27. A can opener according to claim 24, wherein the drive means is adapted for automated drive.

28. A can opener according to claim 24, wherein initial actuation of the drive means is arranged to rotate the cutter wheel to said cutting position in which the cutting knife penetrates through the cylindrical wall of the can, further actuation of the drive means being arranged to rotate the drive wheel to cause the opener to orbit around the can to form said cut therein.

29. A can opener according to claim 28, wherein yet further actuation of the drive means is arranged to rotate the cutter wheel away said cutting position following completion of said cut.

* * * * *